US007484539B1

(12) United States Patent
Huang

(10) Patent No.: US 7,484,539 B1
(45) Date of Patent: Feb. 3, 2009

(54) SHAPING METHOD AND STRUCTURE OF WOVEN FABRIC WITH A GROOVE

(75) Inventor: Chin-Hui Huang, Da-an Township, Taichung County (TW)

(73) Assignee: Ching Sui Industry Co., Ltd., Da-An Township, Taichung County (TW)

( * ) Notice: Subject to any disclaimer, the term of this patent is extended or adjusted under 35 U.S.C. 154(b) by 0 days.

(21) Appl. No.: 11/949,691

(22) Filed: Dec. 3, 2007

(51) Int. Cl.

| | |
|---|---|
| ***D03D 3/02*** | (2006.01) |
| ***D03D 11/02*** | (2006.01) |
| ***D03D 3/00*** | (2006.01) |
| *D03D 3/04* | (2006.01) |
| *D03D 9/00* | (2006.01) |

(52) U.S. Cl. ..... 139/384 R; 139/387 R

(58) Field of Classification Search ..... 139/384 R, 139/387 R

See application file for complete search history.

(56) References Cited

U.S. PATENT DOCUMENTS

| | | | | | |
|---|---|---|---|---|---|
| 2,035,950 | A | * | 3/1936 | Dillingham et al. | 428/128 |
| 2,046,039 | A | * | 6/1936 | Schaar | 139/384 R |
| 2,119,893 | A | * | 6/1938 | Stark | 139/387 R |
| 2,194,038 | A | * | 3/1940 | Wallace, Jr. | 139/387 R |
| 2,424,928 | A | * | 7/1947 | Glendinning et al. | 139/384 R |
| 2,978,787 | A | * | 4/1961 | Leibig | 623/1.51 |
| 3,096,560 | A | * | 7/1963 | Leibig | 28/143 |
| 3,108,357 | A | * | 10/1963 | Leibig | 623/1.38 |
| 3,472,288 | A | * | 10/1969 | Kohlhagen | 139/387 R |
| 3,953,640 | A | * | 4/1976 | Takada | 428/188 |
| 4,048,399 | A | * | 9/1977 | Terzaghi | 429/141 |
| 4,517,687 | A | * | 5/1985 | Liebig et al. | 623/1.52 |
| 4,530,113 | A | * | 7/1985 | Matterson | 623/1.51 |
| 4,665,951 | A | * | 5/1987 | Ellis | 139/387 R |
| 4,668,545 | A | * | 5/1987 | Lowe | 428/35.1 |
| 4,914,836 | A | * | 4/1990 | Horovitz | 36/28 |
| 5,592,977 | A | * | 1/1997 | Kikuchi et al. | 139/387 R |
| 5,800,514 | A | * | 9/1998 | Nunez et al. | 623/1.51 |
| 5,904,714 | A | * | 5/1999 | Nunez et al. | 139/383 R |
| 6,085,802 | A | * | 7/2000 | Silberberg | 139/387 R |
| 6,136,022 | A | * | 10/2000 | Nunez et al. | 623/1.1 |
| 6,315,009 | B1 | * | 11/2001 | Jayaraman et al. | 139/387 R |
| 6,994,724 | B2 | * | 2/2006 | Schmitt | 623/1.51 |
| 2003/0127150 | A1 | * | 7/2003 | Speich et al. | 139/387 R |
| 2008/0042413 | A1 | * | 2/2008 | Coleman et al. | 280/743.1 |

* cited by examiner

*Primary Examiner*—Bobby H Muromoto, Jr.
(74) *Attorney, Agent, or Firm*—Egbert Law Offices PLLC

(57) ABSTRACT

A shaping method for a woven fabric having a hollow looped portion includes the steps of laying top longitudinals and bottom longitudinals in a pattern corresponding to a shape and size of the hollow looped portions, forming top warps and bottom warps in a generally planar pattern, flat weaving a weft through and between the top warps and the bottom warps such that the top warps reside above the weft and said bottom warps reside below the weft, passing the weft between the top longitudinals and the bottom longitudinals in the hollow looped portion such that the top longitudinals reside above the weft and the bottom longitudinals reside below the weft.

1 Claim, 6 Drawing Sheets

SHAPING METHOD AND STRUCTURE OF WOVEN FABRIC WITH A GROOVE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a shaping method and structure of woven fabric, and more particularly to a creative shaping method and structure of woven fabric with a groove.

2. Description of Related Art Including Information Disclosed Under 37 CFR 1.97 and 37 CFR 1.98

Woven fabric is used in various ways in practice. It can be used by itself and also can be combined with other materials to get another product. For example, a groove can be formed along the two sides of a piece of woven fabric for a pole or frame to get through. This combination is often used for backs or seats of leisure chairs The present invention is about a shaping method and structure of the groove of the above-mentioned woven fabric. The prior art is showed in FIG. 1. First, a piece of circle tube fabric 10 is made into a circle by weaving or needle weaving. Second, at the ingression of edges of both sides of Fabric 10, close line 11 is made through stitching. A long and hollow groove 12 is formed between the close line and the edges of both sides of fabric 10.

The prior art still has some problems in practice. First, the circle weaving is done by a circle weaving machine. This circle weaving machine costs much more than a normal flat weaving machine. For the industrial world, cost increasing reduces profit, which does not correspond with usage efficiency. Second, after circle tube fabric 10 is made, stitching is needed to make close linel 1 to form the required groove 12, which obviously reduces process efficiency and increases costs. Third, the practical tension and elasticity of fabric 10 made by circle weaving or needle weaving are not good. Thread might fall and shape might be twisted, which reduces intensity.

Thus, to overcome the aforementioned problems of the prior art, it would be an advancement in the art to provide an improved structure can significantly improve efficacy.

Therefore, the inventor has provided the present invention of practicability after deliberate design and evaluation based on years of experience in the production, development and design of related products.

BRIEF SUMMARY OF THE INVENTION

The improvements of the present invention are compared with the prior art. In the prior art, at the two sides of the edges of the circle tube fabric, stitching is needed to make close line to form the required groove, which reduces process efficiency and increases costs. And the tension is not good, either. In the present invention, a finished product of woven fabric 20 with groove 23 is made through flat weaving. Therefore, a normal flat weaving machine with low costs can be used for manufacturing. Additionally, during weaving of warp and weft, groove 23 can be formed directly without a second stitching process, such as stitching close used by prior art. This invention uses one thread of weft in the whole weaving process to make the whole structure united, and tension and elasticity are greatly increased. Therefore, the present invention can really reduce producing costs, and increase efficiency of production, structural tension and industrial use efficiency. It is practical and advanced.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
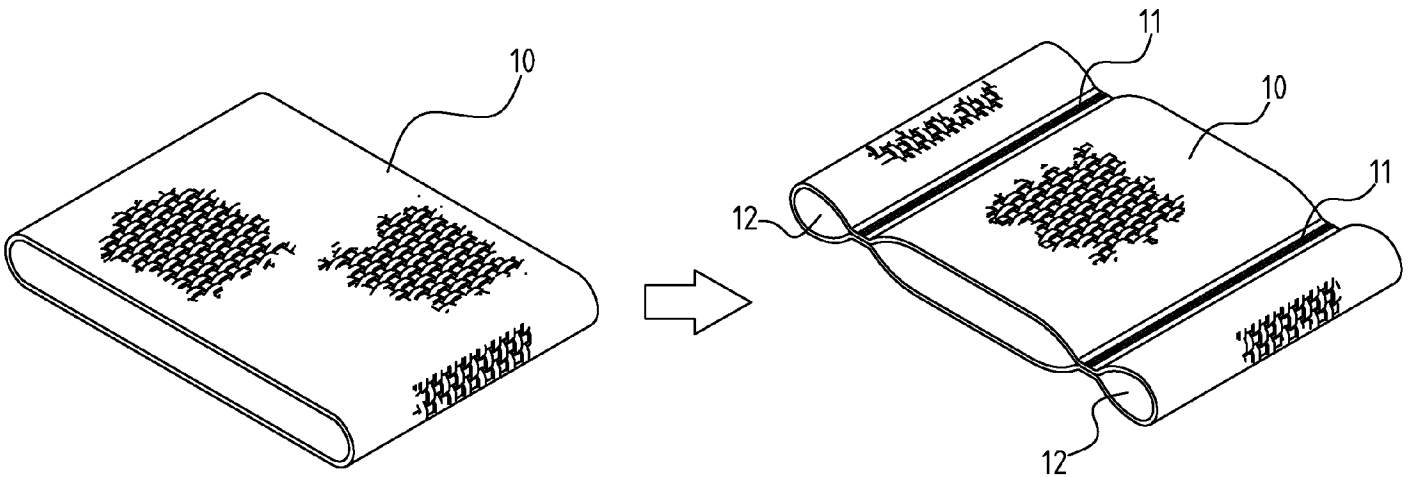
FIG. 1 shows a perspective view of the prior art.
Figure 2:
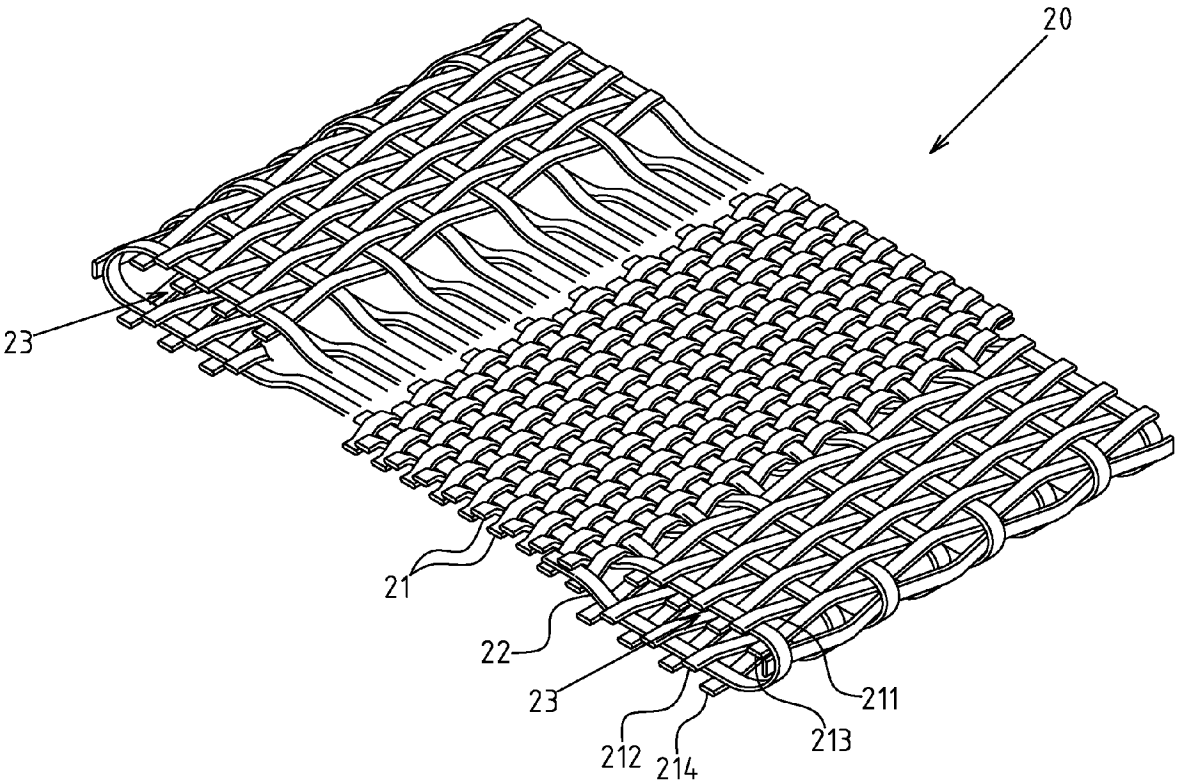
FIG. 2 shows a perspective view of the structure of the present invention.
Figure 3:
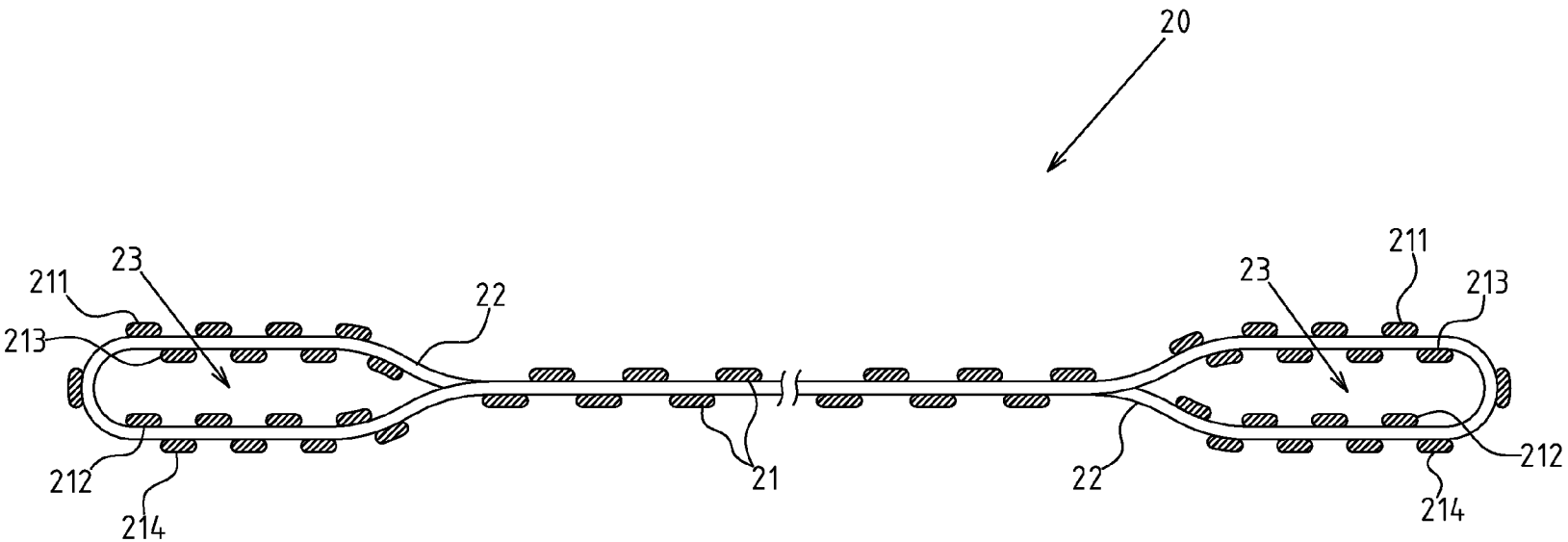
FIG. 3 shows a cross-sectional view of the structure of the present invention.

FIGS. 2 and 3 are the well implemented examples of the present invention of the shaping method and structure of woven fabric with a groove. The examples are only for illustration. The application for patent is not limited to the structure shown. Fabric 20 is made with warp 21 and weft 22 through flat inter-weaving, and the two sides of fabric 20 form a hollow groove. The present invention includes the groove 23, formed by warp 21 and weft 22 of fabric 20 itself.

Figure 6:
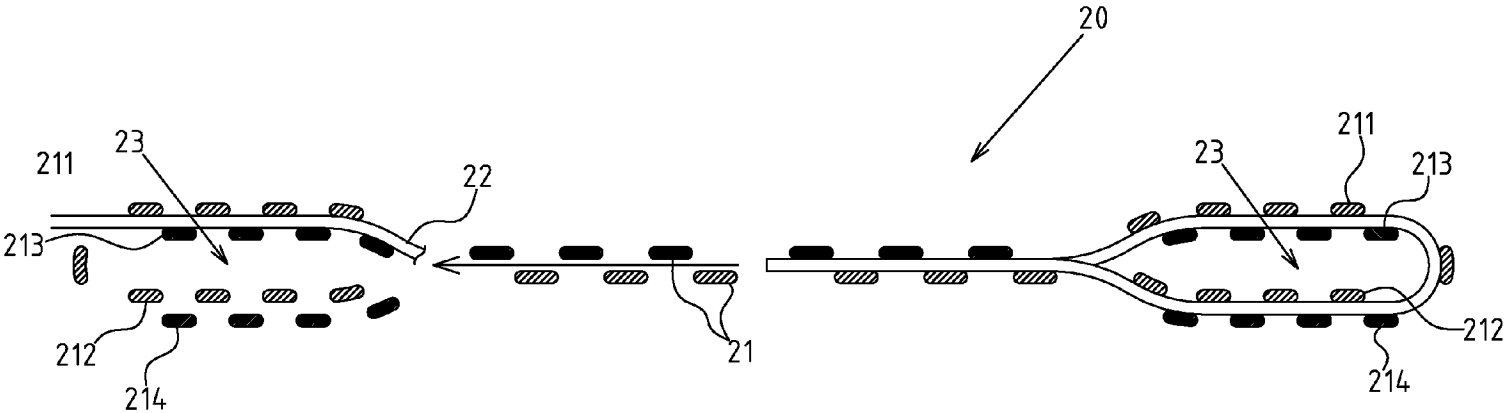

The shaping method includes:

a. Before weaving of fabric 20 (see FIG. 4), top longitude 211 and 213 and bottom warp 212 and 214 are laid in the area of groove 23.

b. During the process of weaving of fabric 20, weft 22 is crossed over the crisscrossed top and bottom warp 21 consequently. When weft 22 gets through the area of groove 23, cross top warp 211 and 213 are made to form a criss-crossed area. (see FIGS. 4 and 5).

c. When weft 22 is shuttling back and forth and crossing the area of groove 23, the weft 22 shall be made to cross the criss-cross area formed by bottom warp (see FIGS. 6 and 7).

d. Steps (b) and (c) are repeated, exchanging between top and bottom of warp 21 when weft 22 crosses the same area. The finished product of fabric 20 with groove 23 can be made through flat weaving (see FIG. 2).

Figure 4:
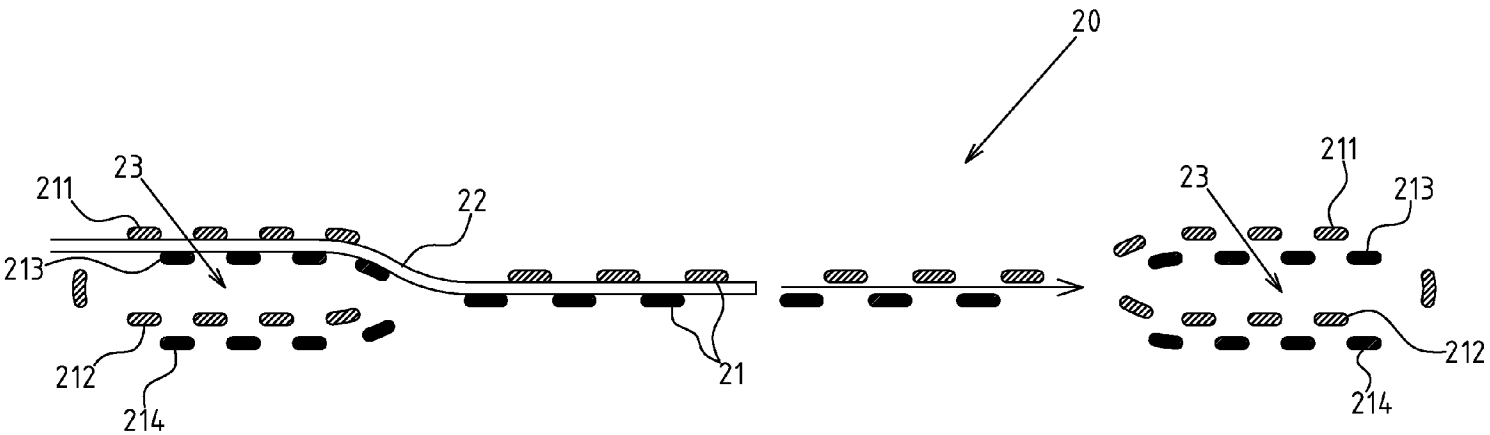
FIGS. 4-8 are cross-sectional views showing the shaping procedures of the present invention.
Figure 5:
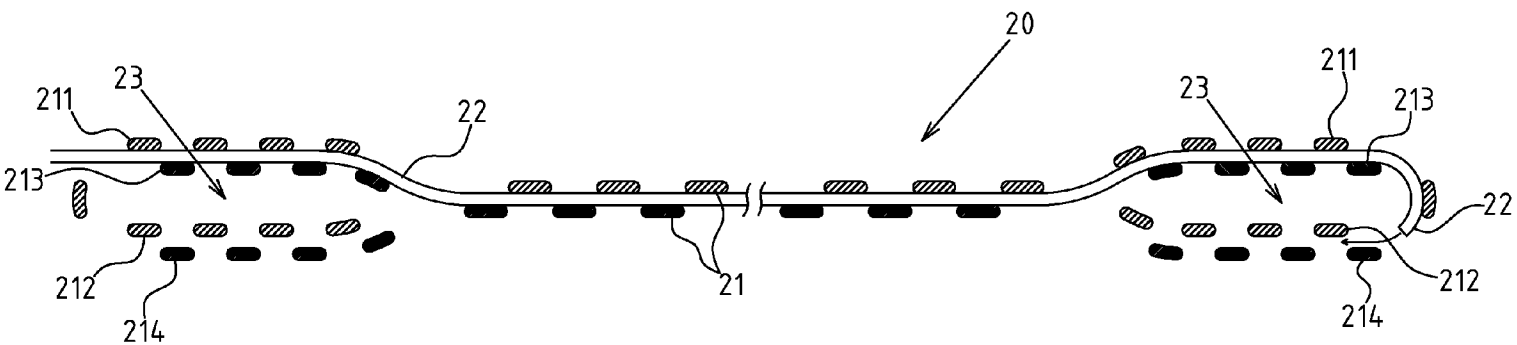
Figure 7:
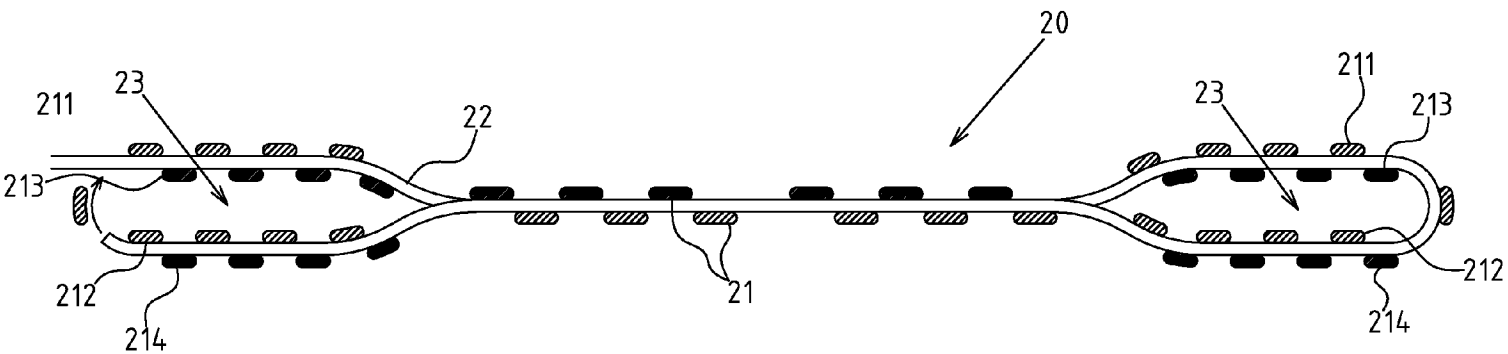
Figure 8:
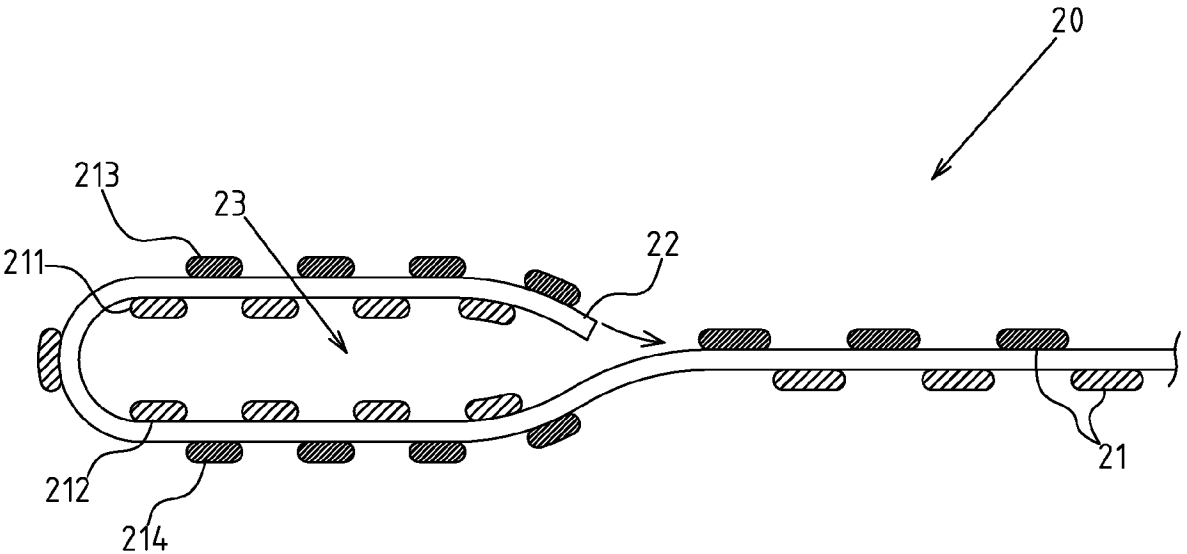

The exchange of top and bottom warp 21 mentioned in (d) is a necessary operation in flat weaving. The purpose is to make crisscrosses through the exchange of top and bottom warp 21 when weft 22 crosses the same area again during the process of shuttling back and forth. Talking about the exchange of top and bottom of warp 21, according to the differences of FIGS. 4 and 7, FIG. 4 shows the status of weft 22 crossing the area of warp 21 consequently. At this moment, the dark colored warp 21 is at the bottom, and the light colored warp 21 is on the top, dark and light color being presented through the degree of closeness of the profile. FIG. 7 shows the status of weft 22 shuttling back and crossing the area of warp 21. At this moment, the dark-colored longitude 21 is on the top and lighter-colored longitude 21 is at the bottom. Of course, the mentioned warp include the top longitudes 211 and 213 and the bottom warp 212 and 214 forming the area of groove 23. And the exchange status is known according to the difference of FIGS. 4 and 8. FIG. 4 shows the status of weft 22 crossing the area of warp 211 and 213 consequently. At this moment, the dark colored top warp 213 is at the bottom and light colored warp 211 is on the top. However, FIG. 8 shows the status of weft 22 shuttling back and crossing again through the top warp 211 and 213. At this moment, the dark colored warp 21 is on the top and the light colored warp 21 is at the bottom.

From the above illustration, it is known that the present invention provides a woven fabric structure with groove. The woven fabric 20 is woven through crisscross of several warp 21 and wefts 22. The edges of the two sides of the woven fabric 20 form a hollow groove 23. The difference between the woven fabric 20 of the present invention and the prior structure is that the groove 23 is formed by the warp 21 and weft 22 of the woven fabric itself. The area of groove 23 has separate top warp 211 and 213 and bottom warp 212 and 214, which make weft 22 cross the top warp 211 and 213 and bottom warp 212 and 214 in a shape of U in order and then cross structure of warp 21 of the middle area of the woven fabric. Therefore, the woven fabric's own crisscrossed warp 21 and weft 22 can form hollow groove 23 without stitching close.

In addition, in order to clearly present the shuttling route of weft 22, and in the steps of FIGS. 4 and 8, the present invention makes weft 22 cross the top warp 211 and 213 and the bottom warp 212 and 214 windingly. But in practice, the weft 22 is led by a shuttle in the flat weaving machine to shuttle straightly, which means normally weft 22 shuttles straightly and there are no winding routes. Weft 22 is led and controlled by the weft 211 and 213 and the bottom warp 212 and 214 change positions and move and to further make finished product of woven fabric 20. Therefore, this paragraph is written to avoid readers' misunderstanding.

I claim:

1. A shaping method for a woven fabric having a hollow looped portion, the shaping method comprising:

laying top longitudinals and bottom longitudinals in a pattern corresponding to a shape and size of the hollow looped portion, the top longitudinals being offset from and in spaced relation to the respective adjacent bottom longitudinals;

forming top warps and bottom warps in a generally planar pattern, the top warps being offset from and in spaced relation to the respective adjacent bottom warps;

flat weaving a weft through and between said top warps and said bottom warps such that said top warps reside above said weft and said bottom warps reside below said weft;

passing said weft between said top longitudinals and said bottom longitudinals in said hollow looped portion such that said top longitudinals reside above said weft and said bottom longitudinals reside below said weft;

returning said weft from said hollow looped portion toward said top warps and said bottom warps;

weaving said weft through said top warps and said bottom warps such that said top warps reside below said weft and such that said bottom warps reside above said weft;

returning said weft toward said hollow looped portion; and weaving said weft through said top longitudinals and said bottom longitudinals such that said top longitudinals reside below said weft and such that said bottom longitudinals reside above said weft.

* * * * *